US009535355B2

(12) United States Patent
Jota et al.

(10) Patent No.: US 9,535,355 B2
(45) Date of Patent: Jan. 3, 2017

(54) IMAGE FORMING APPARATUS

(71) Applicant: CANON KABUSHIKI KAISHA, Tokyo (JP)

(72) Inventors: Yusuke Jota, Suntou-gun (JP); Atsushi Toda, Fuji (JP); Masahito Kato, Gotemba (JP); Kenta Shibukawa, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/058,417

(22) Filed: Mar. 2, 2016

(65) Prior Publication Data

US 2016/0259261 A1 Sep. 8, 2016

(30) Foreign Application Priority Data

Mar. 6, 2015 (JP) ..... 2015-044417

(51) Int. Cl.
*G03G 15/02* (2006.01)

(52) U.S. Cl.
CPC ..... *G03G 15/0266* (2013.01)

(58) Field of Classification Search
CPC ..... G03G 15/0266
See application file for complete search history.

(56) References Cited

U.S. PATENT DOCUMENTS

| | | | | |
|---|---|---|---|---|
| 8,548,348 | B2 * | 10/2013 | Sakata | G03G 15/02 399/48 |
| 8,718,505 | B2 | 5/2014 | Sakata et al. | |
| 8,983,317 | B2 | 3/2015 | Sakata | |
| 2014/0147140 | A1 * | 5/2014 | Shirakata | G03G 15/0266 399/50 |

FOREIGN PATENT DOCUMENTS

| | | | |
|---|---|---|---|
| JP | 566638 | A | 3/1993 |
| JP | 2012013381 | A | 1/2012 |
| JP | 2013125097 | A | 6/2013 |

* cited by examiner

*Primary Examiner* — Hoang Ngo
(74) *Attorney, Agent, or Firm* — Rossi, Kimms & McDowell LLP

(57) ABSTRACT

Voltages are applied to an image bearing member using at least three application voltage values which are larger than a discharge start voltage value and which have different magnitudes, at least one of the application voltage values having a value at which a direction of a current corresponding to the one of the application voltage values is reverse to those of currents corresponding to the other application voltage values. A relation between the application voltage value and the detection current value in a discharge area is calculated based on at least three application voltage values $V_{d1}$, $V_{d2}$, $V_{d3}$ and at least three detection current values $I_{d1}$, $I_{d2}$, $I_{d3}$ detected by a current detection portion in relation to at least three application voltage values $V_{d1}$, $V_{d2}$, $V_{d3}$ and a voltage value $V_0$ at which the detection current value is zero is calculated based on the relation in the discharge area.

13 Claims, 10 Drawing Sheets

IMAGE FORMING APPARATUS

BACKGROUND OF THE INVENTION

Field of the Invention

The present invention relates to an image forming apparatus that forms an image on a recording medium (for example, a recording sheet, an OHP sheet, a cloth, or the like) using an electrophotographic system and relates to a process cartridge. Here, a process cartridge is a cartridge in which an electrophotographic photosensitive member (hereinafter referred to as photosensitive member) serving as an image bearing member is integrated with at least one of a charging means, developing means, and cleaning means as image forming process means acting on the photosensitive member. The process cartridge allows the cartridge to be detachably attached to an image forming apparatus body. Examples of an image forming apparatus include an electrophotographic copying machine, an electrophotographic printer (for example, a laser beam printer, an LED printer, or the like), a facsimile apparatus, and a composite machine thereof.

Description of the Related Art

Conventionally, in an image forming apparatus which uses an electrophotographic system, first, charging means charges the surface of a photosensitive member to a desired potential and developing means causes developer to adhere to a latent image formed on the photosensitive member by the exposure means to form a developer image. Moreover, transfer means transfers the developer image to a recording medium, a fixing member fixes the image on the recording medium by applying heat and pressure to the recording medium, and the image is output. However, when a voltage is applied to the charging means, since a discharge start voltage is different depending on an ambient temperature or humidity, a thickness of a surface layer of the photosensitive member, or the like, the surface potential of the photosensitive member is different depending on conditions even if the same voltage is applied to the charging means. Moreover, since the sensitivity of the photosensitive member to the exposure means is different, the surface potential of the exposed photosensitive member is not constant even when the same exposure means is used. If the surface potential of the photosensitive member is not constant, the image density changes depending on conditions.

Thus, according to the invention disclosed in Japanese Patent Application Publication No. H5-66638, the surface potential of a photosensitive member is measured and fed back to control image formation so that a constant potential is always maintained. Moreover, according to the inventions disclosed in Japanese Patent Application Publication Nos. 2013-125097 and 2012-13381, a discharge start voltage is calculated, a surface potential is calculated from the information and is fed back to control image formation so that the surface potential of the photosensitive member is always constant.

The configuration proposed in Japanese Patent Application Publication No. H5-66638 can measure an accurate surface potential by directly measuring the surface potential. However, the space for installing a surface potentiometer is required, which may increase the apparatus size, and the installation cost for the surface potentiometer is required, which may increase the apparatus cost. The configuration proposed in Japanese Patent Application Publication Nos. 2013-125097 and 2012-13381 can measure the surface potential of a photosensitive member without adding a member to an image forming apparatus. However, the surface potential of a photosensitive member is preferably detected as quickly as possible.

SUMMARY OF THE INVENTION

An object of the present invention is to detect a surface potential of a photosensitive member with high accuracy and in a short period.

Another object of the present invention is to provide an image forming apparatus comprising:

an image bearing member that bears a toner image for forming an image on a recording material;

a voltage application member that applies a voltage to the image bearing member;

a current detection portion that detects a current value of current flowing through the image bearing member;

a potential detection portion that calculates a voltage value $V_0$ at which a detection current value detected by the current detection portion is zero based on the application voltage value applied by the voltage application member to the image bearing member and the detection current value detected when the application voltage value is applied; and a latent image forming portion that forms on a surface of the image bearing member a potential difference for forming an electrostatic latent image for forming the toner image on the surface of the image bearing member based on the voltage value $V_0$ calculated by the potential detection portion, wherein the voltage application member applies voltages to the image bearing member using at least three application voltage values which are larger than a discharge start voltage value, which is a voltage value at which discharge starts occurring between the image bearing member and the voltage application member, and which have different magnitudes, at least one of the three application voltage values being a value at which a direction of a current corresponding to the one of the application voltage values is reverse to those of currents corresponding to the other application voltage values, the potential detection portion calculates a relation between the application voltage value and the detection current value in a discharge area in which the discharge occurs, based on the at least three application voltage values and at least three detection current values detected by the current detection portion in relation to the at least three application voltage values, and the potential detection portion calculates the voltage value $V_0$ according to Expression (1) based on the relation in the discharge area, in which $V_1$ is a voltage value corresponding to a predetermined current value $I_1$ in the discharge area and $V_2$ is a voltage value corresponding to a current value $-I_1$:

$$V_0=(V_1+V_2)/2 \quad (1).$$

Further features of the present invention will become apparent from the following description of exemplary embodiments (with reference to the attached drawings).

DESCRIPTION OF THE EMBODIMENTS

Embodiments of the present invention will now be described in detail with reference to the drawings. The dimensions, materials, shapes, relative positions or the like of the components described in the embodiments should be appropriately changed depending on the configuration and various conditions of an apparatus to which the invention is applied, and are not intended to limit the scope of the invention to the following embodiments.

Example 1

(1) Image Forming Apparatus

Figure 2:
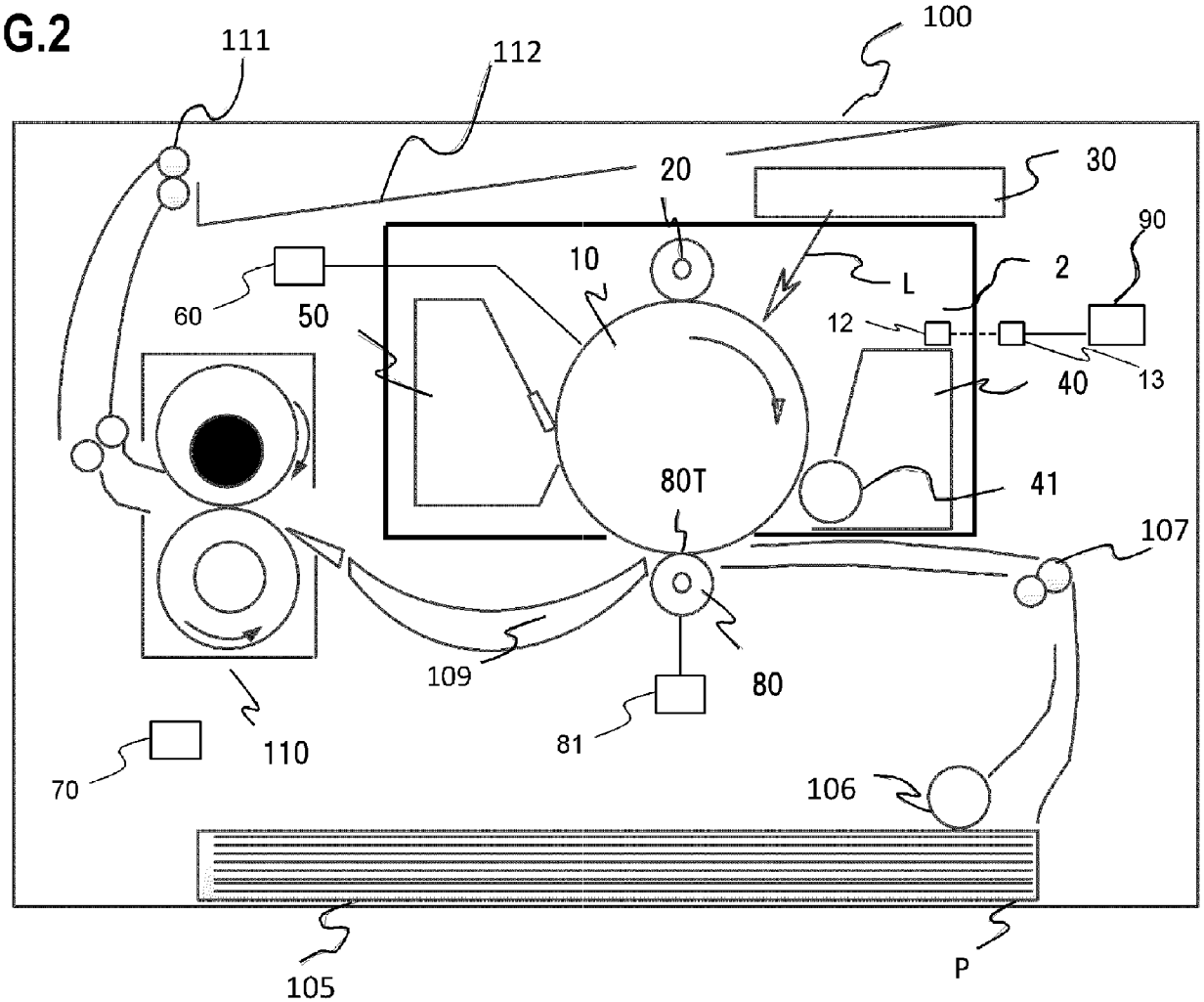
FIG. 2 is a schematic configuration diagram of an image forming apparatus according to Example 1.

FIG. 2 is a schematic configuration diagram of an image forming apparatus 100 according to an embodiment of the present invention. The image forming apparatus 100 of the present embodiment is a laser beam printer which uses an electrophotographic process. A process cartridge 2 configured to be detachably attached to a printer body (the apparatus body of an image forming apparatus) is provided in the image forming apparatus 100. The "printer body (apparatus body)" referred herein means a configuration excluding the process cartridge 2 from the image forming apparatus 100. The process cartridge 2 will be described in detail in Section (2). An image forming apparatus to which the present invention can be applied is not limited to that illustrated herein. For example, the present invention can be applied to a color light beam printer in which a plurality of process cartridges 2 are prepared and a toner image of a plurality of colors is transferred to a recording material using an intermediate transfer belt (intermediate transfer member) to form a color image.

A rotating drum-type electrophotographic photosensitive member (hereinafter referred to as a photosensitive drum) 10 as an image bearing member is driven to rotate at a predetermined circumferential velocity in a clockwise direction indicated by an arrow. The photosensitive drum 10 is uniformly charged to a predetermined potential of a predetermined polarity by a contact charging roller 20 (charging portion) in the course of rotation. In the present embodiment, the surface of the photosensitive drum 10 is charged to a predetermined negative potential by the voltage applied to the charging roller 20. A laser beam scanner 30 as image exposure means (exposure portion) outputs a light beam L which is on/off-modulated according to a time-series electrical digital pixel signal of target image information input from an external apparatus such as an image scanner or a computer (not illustrated). The laser beam scanner 30 scans and exposes (irradiates) a charging surface of the photosensitive drum 10 with the light beam L. With this scanning exposure, the charges of the exposed bright portion on the surface of the photosensitive drum 10 are neutralized, and an electrostatic latent image corresponding to the target image information is formed on the surface of the photosensitive drum 10.

A developing assembly 40 has a developing sleeve 41 (developer bearing member) that supplies developer (toner) to the surface of the photosensitive drum 10, and the electrostatic latent image on the surface of the photosensitive drum 10 is sequentially developed as a toner image which is a transferrable image by the developing sleeve 41. The developing assembly 40 will be described in detail in Section (3). In the present embodiment, a jumping development system which uses a magnetic mono-component thermal noise (hereinafter referred to as toner) as the developer and a reverse development system which develops the exposed bright portion of the electrostatic latent image with negative toner are employed. In this example, although an embodiment which uses the developing sleeve 41 as a developer bearing member is employed, the form of the developer bearing member is not limited to this but may be a developing roller, for example.

Recording materials P as recording media stacked and stored in a sheet feed cassette 105 are separated one by one and fed when a sheet feed roller 106 is driven based on a feed start signal. Moreover, the recording material P is guided to a transfer segment 80T at a predetermined timing by a registration roller 107, the transfer segment being a contacting nip between the photosensitive drum 10 and a transfer roller 80 serving as a contacting and rotating transfer member. That is, the conveying of the recording material P is controlled by the registration roller 107 so that a distal end of the recording material P exactly arrives at the transfer segment 80T when the distal end of the toner image on the photosensitive drum 10 arrives at the transfer segment 80T. The recording material P guided to the transfer segment 80T is conveyed by being sandwiched between the transfer roller 80 and the transfer segment 80T, and a predetermined transfer voltage (transfer bias) which is a DC voltage is applied to the transfer roller 80 from a transfer bias application source 81. When a transfer bias of the opposite polarity from the toner is applied to the transfer roller 80, the toner image on the surface of the photosensitive drum 10 at the transfer segment 80T is electrostatically transferred to the surface of the recording material P.

The recording material P to which the toner image is transferred at the transfer segment 80T is separated from the surface of the photosensitive drum 10 and is guided to a heating and fixing apparatus 113 as a heating apparatus through a conveying guide 109, and the toner image is thermally fixed. On the other hand, the surface of the photosensitive drum 10 after the recording material is separated (after the toner image is transferred to the recording material P) is cleaned by a cleaning apparatus 50 by removing untransferred toner, paper dust, or the like and is repeatedly provided for image formation. The recording material P having passed through the heating and fixing apparatus 113 is discharged to a discharge tray 112 from a discharge port 111. The image forming apparatus 100 includes surface potential detection means that detects the surface potential of the photosensitive drum 10, and in the present embodiment, the transfer roller 80 which is a transfer member and a voltage application method performs a portion of the role of the surface potential detection means. Moreover, control of various operations required for the image forming apparatus such as charging, developing, exposure, transferring, and drum-driving, and various calculations and storage of various items of information required for the control are performed by a control portion (CPU) 90. The control portion 90 forms various means of the present invention together with other constituent elements. For example, the control portion 90 forms a potential detection portion (calculation portion) that calculates the surface potential of the photosensitive drum 10 and also forms a latent image forming portion together with the charging roller 20 and the laser beam scanner 30. Moreover, the control portion 90 forms a current detection portion together with a current sensor 60 as current detection means. In the following description, calculation values calculated according to various calculation formulas based on various detection values may be actually calculated in a real-time basis. A table in which detections values and calculation values are correlated with each other may be prepared and the calculation values may be acquired by referring to the table.

(2) Process Cartridge

Figure 3:
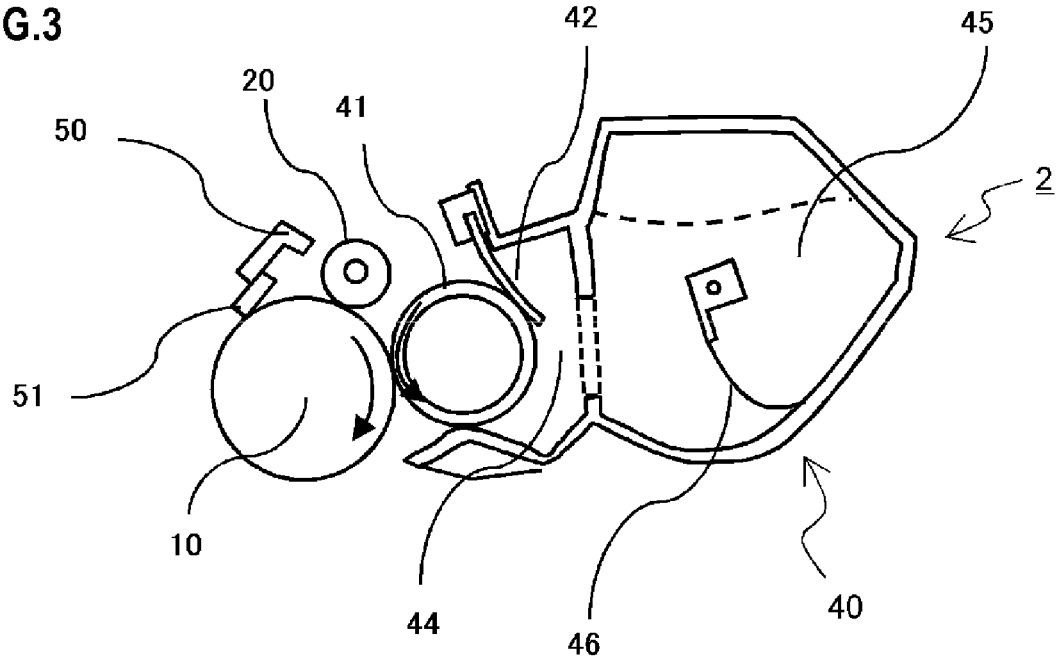
FIG. 3 is a schematic configuration diagram of a process cartridge according to Example 1.

FIG. 3 is a schematic configuration diagram of the process cartridge 2 according to the present embodiment. The process cartridge 2 is a cartridge which is configured to be detachably attached to the body of the image forming apparatus, and in which four process apparatuses of the photosensitive drum 10, the charging roller 20, the developing assembly 40, and the cleaning apparatus 50 are integrated. When the process cartridge 2 is mounted, an opening/closing portion (not illustrated) of the printer body is opened to open the printer body and the process cartridge 2 is inserted up to a predetermined attachment position along a guide portion (not illustrated). In a state in which the process cartridge 2 is attached to the printer body, the laser beam scanner 30 as the image exposure means is positioned above the process cartridge 2. Moreover, when the process cartridge 2 is detached, operations reverse to those during attachment may be performed.

The photosensitive drum 10 and the charging roller 20 are attached to the frame of the cleaning apparatus 50. The cleaning apparatus 50 has a cleaning blade 51, and the photosensitive drum 10, the charging roller 20, and the cleaning apparatus 50 forms a cleaning unit. The developing assembly 40 is configured as a developing unit separate from the cleaning unit in a state in which a developing chamber 44 in which the developing sleeve 41 is rotatably arranged in an opening thereof is coupled with a toner chamber 45 in which toner T is stored. The toner T in the toner chamber 45 is stirred in the toner chamber 45 by a rotating toner stirring device 46 and is supplied to the developing chamber 44 through a communication hole that communicates with the toner chamber 45 and the developing chamber 44. The toner T in the developing chamber 44 is born on the surface of the developing sleeve 41 with the thickness thereof being restricted while being triboelectrically charged by a developing blade 42.

A memory 12 as a storage medium is provided in the surface of the frame of the process cartridge 2, and a communication portion 13 that exchanges signals with the memory 12 is provided on the printer body. According to the present embodiment, a controller of the control portion 90 provided in the printer body can write and read information to and from the memory 12 via the communication portion 13. In the present embodiment, "use history values" changing with use from the first use time of the developing assembly 40 is written to and stored in the memory 12. Here, the "use history values" of the developing assembly 40 are the integrated values from the first use time (the starting time to use), of the rotation periods (the number of rotations) of each unit of the photosensitive drum 10, the charging roller 20, and the developing sleeve 41, for example.

(3) Surface Potential Detection Means

The surface potential detection means detects the surface potential of the photosensitive drum 10 during image formation. In the present embodiment, the transfer roller 80 is used for the surface potential detection means. The magnitude of a voltage applied to the photosensitive drum 10 is determined by the control portion 90 controlling the magnitude of a voltage supplied from the transfer bias application source 81 to the transfer roller 80. That is, the application voltage value controlled by the control portion 90 is used for detection (calculation) of the surface potential. By using the transfer roller 80 for the surface potential detection means, it is possible to detect the surface potential of the photosensitive drum 10 without adding a member. The charging roller 20 may be used for the surface potential detection means as a voltage application member.

An electrostatic latent image is formed according to a potential difference on the photosensitive drum 10. It is important to detect a surface potential of the photosensitive drum 10 accurately to form images stably. In the present embodiment, the surface potential is detected in a state in which the photosensitive drum 10 is at a uniform exposure potential ($V_L$). The information on the detected surface potential of the photosensitive drum 10 is transmitted to the control portion 90 of the image forming apparatus, and various image formation parameters are controlled to stabilize the image quality in the image forming process. For example, a laser intensity of a laser scanner unit or a charging bias is changed to control the surface potential of the photosensitive drum 10. A developing bias may be changed to control the surface potential (exposure potential) of the photosensitive drum 10 and the contrast of the developing bias. In the present embodiment, the laser intensity of the laser scanner unit is change to control the surface potential of the photosensitive drum 10 and to stabilize the image quality.

(Method of Calculating Surface Potential of Photosensitive Drum 10)

Figure 5:
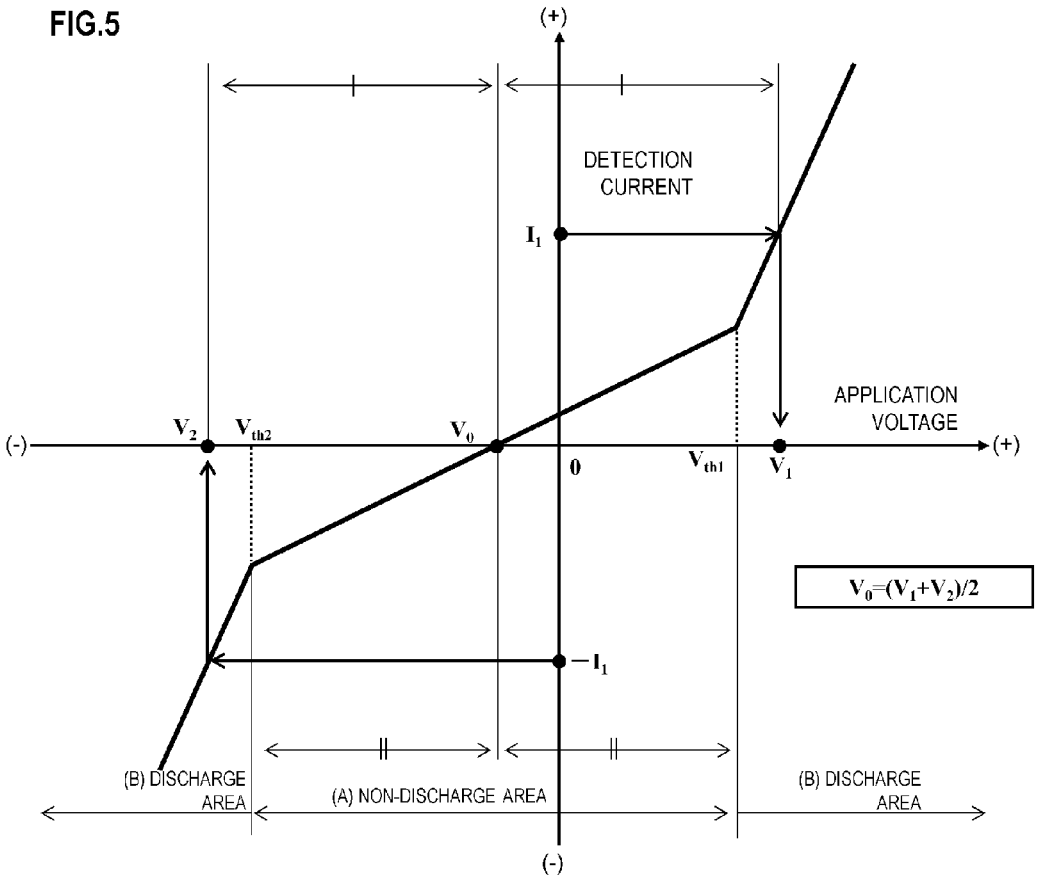
FIG. 5 is a schematic diagram for describing the features of Example 1.

FIG. 5 is a diagram illustrating the relation between an application voltage value applied to the transfer roller 80 and the current value flowing through the photosensitive drum 10. In FIG. 5, an area (the area indicated by (A)) in which an application voltage value applied to the transfer roller 80 is smaller than discharge start voltage values $V_{th1}$ and $V_{th2}$ is an area (hereinafter referred to as a non-discharge area) in which a dark current flows between the transfer roller 80 and the photosensitive drum 10. An area (the area indicated by (B)) in which an application voltage value applied to the transfer roller 80 is equal to or larger than the discharge start voltage values $V_{th1}$ and $V_{th2}$ is an area (hereinafter referred to as a discharge area) in which a discharge phenomenon occurs between the transfer roller 80 and the photosensitive drum 10.

In FIG. 5, a voltage value $V_0$ at which the current value flowing through the photosensitive drum 10 is zero will be referred to as a surface potential of the photosensitive drum 10. As illustrated in FIG. 5, the application voltage and the detection current are in a symmetrical relation with respect to $V_0$. The influences on the discharge start voltage, of the thickness and the sensitivity of the photosensitive drum 10, an ambient temperature, an ambient humidity, an electrical resistance value of the transfer roller 80, and the like are calculated in prior examinations, a largest discharge start voltage value is calculated based on the influences, and a voltage equal to or larger than the largest value is applied. Moreover, a current value corresponding to the discharge area may be calculated in prior examinations, and if a detection current value is equal to or larger than the value, it may be determined that the detection current value corresponds to the discharge area. Since the application voltage value and the detection current value are in a linear relation in the discharge area, it is possible to calculate the relation between the application voltage value and the detection current value in the discharge area by measuring these three points. In the present embodiment, it is not necessary to calculate the discharge start voltage value to detect the surface potential of the photosensitive drum 10.

(Detailed Description of Surface Potential Detection Means of Photosensitive Drum 10)

Figure 4:
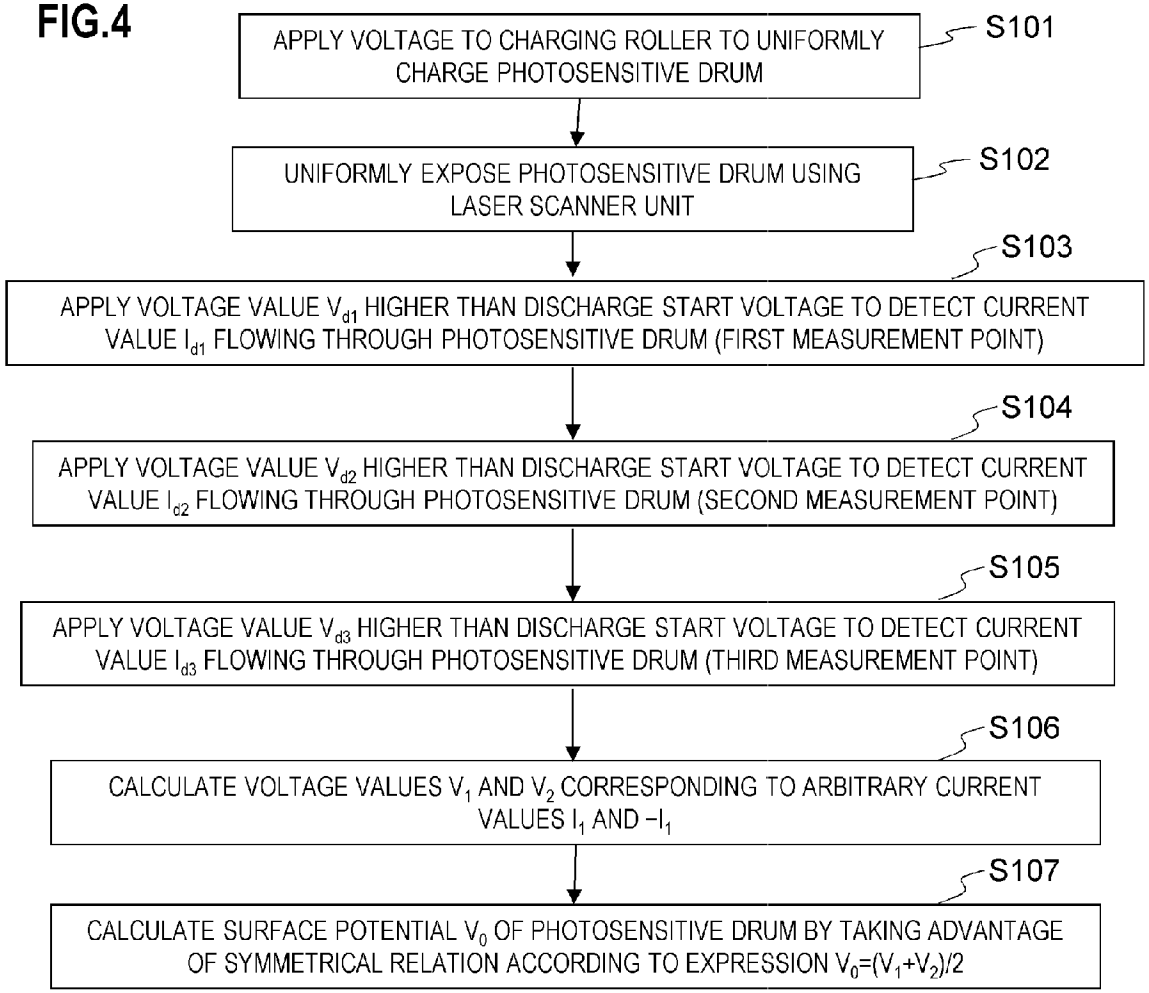
FIG. 4 is a flowchart for describing the features of Example 1.

FIG. 4 is a diagram illustrating the flowchart of a method for detecting the surface potential of the photosensitive drum 10. A voltage is applied to the charging roller 20 during rotation of the photosensitive drum 10 so that the photosensitive drum 10 is uniformly charged (S101). In the present embodiment, the surface of the photosensitive drum 10 was charged to −500 V. The surface of the photosensitive drum 10 is uniformly exposed by the laser scanner unit 30 which is an exposure apparatus so that the surface of the photosensitive drum 10 is at an exposure potential (S102). In the present embodiment, the surface was exposed with light intensity of 3 $mW/m^2$. Subsequently, a voltage is applied to the transfer roller 80 and the current flowing through the photosensitive drum 10 at that time is detected by the current sensor 60 as current value detection means.

Figure 1:
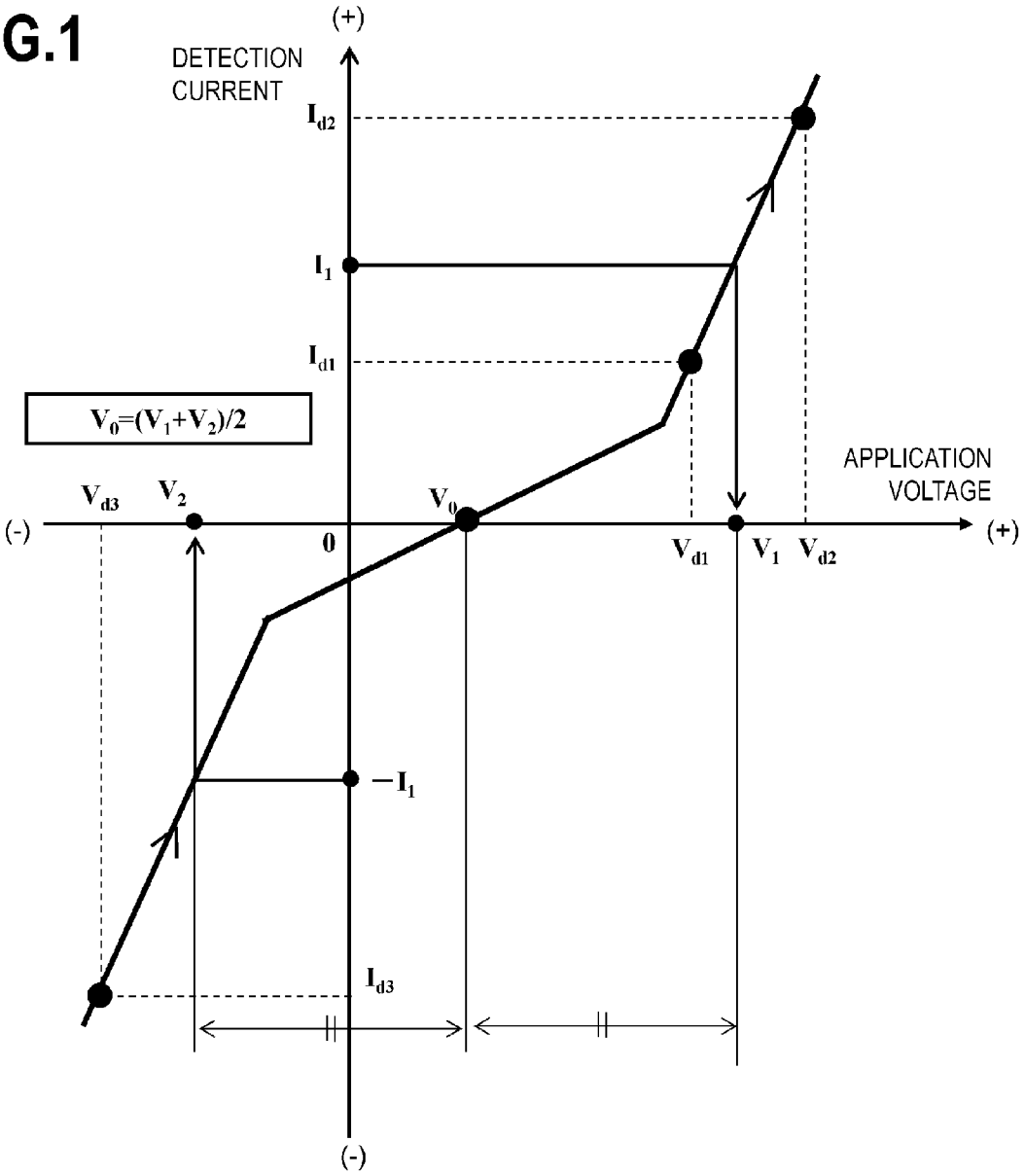
FIG. 1 is a schematic diagram for describing the features of Example 1.

FIG. 1 is a diagram illustrating the relation between an application voltage value applied to the transfer roller 80 and the current value flowing through the photosensitive drum 10 according to the present embodiment. In the present embodiment, first, a voltage $V_{d1}$ equal to or larger than the discharge start voltage value is applied to the transfer roller 80, and a current $I_{d1}$ flowing through the photosensitive drum 10 at that time is detected by current detection means (S103). Subsequently, a voltage $V_{d2}$ equal to or larger than the discharge start voltage value and higher than the voltage $V_{d1}$ is applied to the transfer roller 80, and a current $I_{d2}$ flowing through the photosensitive drum 10 at that time is detected by the current detection means (S104). Subsequently, a voltage $V_{d3}$ equal to or larger than the discharge start voltage value is applied to the transfer roller 80, and a current $I_{d3}$ flowing through the photosensitive drum 10 at that time is detected by the current detection means (S105). Here, the application voltage value $V_{d3}$ is set so that the direction of the current $I_{d3}$ is reverse to that of the currents $I_{d1}$ and $I_{d2}$.

The relation between the application voltage value and the detection current value in the discharge area (the area indicated by (2) in FIG. 5) is obtained from the results of the three measurement points, that is, based on an inclination calculated from the voltage $V_{d1}$, the current $I_{d1}$, the voltage $V_{d2}$, and the current $I_{d2}$, and the voltage $V_{d3}$ and current $I_{d3}$. Moreover, from the relation between the application voltage value and the detection current value in the discharge area, an application voltage value $V_1$ corresponding to an arbitrary current value $I_1$ in the discharge area and an application voltage value $V_2$ corresponding to a current value, $-I_1$, of which the absolute value is the same as $I_1$ and the direction is reverse to $I_1$ are calculated (S106). Moreover, the surface potential $V_0$ of the photosensitive drum 10 is calculated according to $V_0=(V_1+V_2)/2$ by taking advantage of the symmetry of the application voltage value and the detection current value in the discharge area (S107).

In the present embodiment, although the relation between the application voltage value and the detection current value in the discharge area is calculated from three measurement points, measurement may not always be performed at three points but the relation may be calculated from four or more measurement points. Moreover, the application voltage value and the detection current value may be scanned to calculate the relation between the application voltage value and the detection current value in the discharge area.

(Effect Verification 1)

Figure 6:
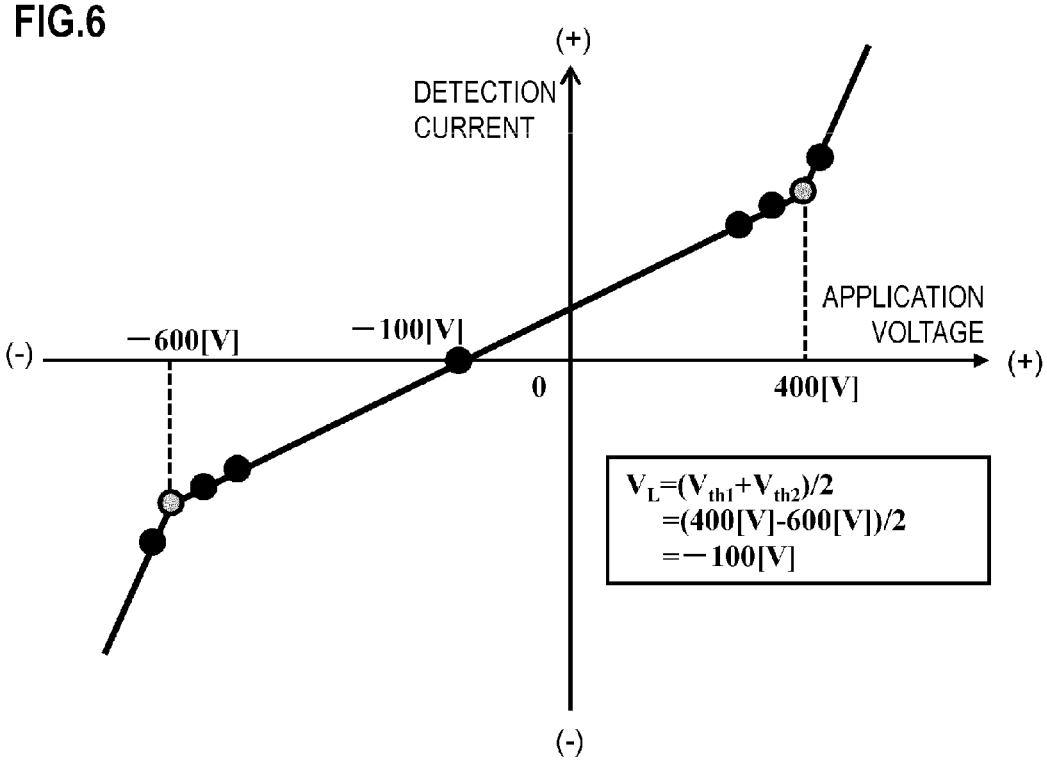
FIG. 6 is a schematic diagram for describing Comparative Example 1.

FIG. 6 is a diagram illustrating the relation between the application voltage value and the detection current value in a configuration of Comparative Example 1 of the present embodiment. The following verifications were conducted to check the effect of reducing the surface potential detection time of the photosensitive drum 10. In the configuration of Comparative Example 1, in order to calculate discharge start voltages $V_{th1}$ and $V_{th2}$, the voltage on the positive side was increased from +300 V with a step of 50 V and the voltage on the negative side was decreased from −500 V with a step of 50 V. The discharge start voltage value was detected while detecting the current value flowing through the photosensitive drum 10 at that time.

Figure 7:
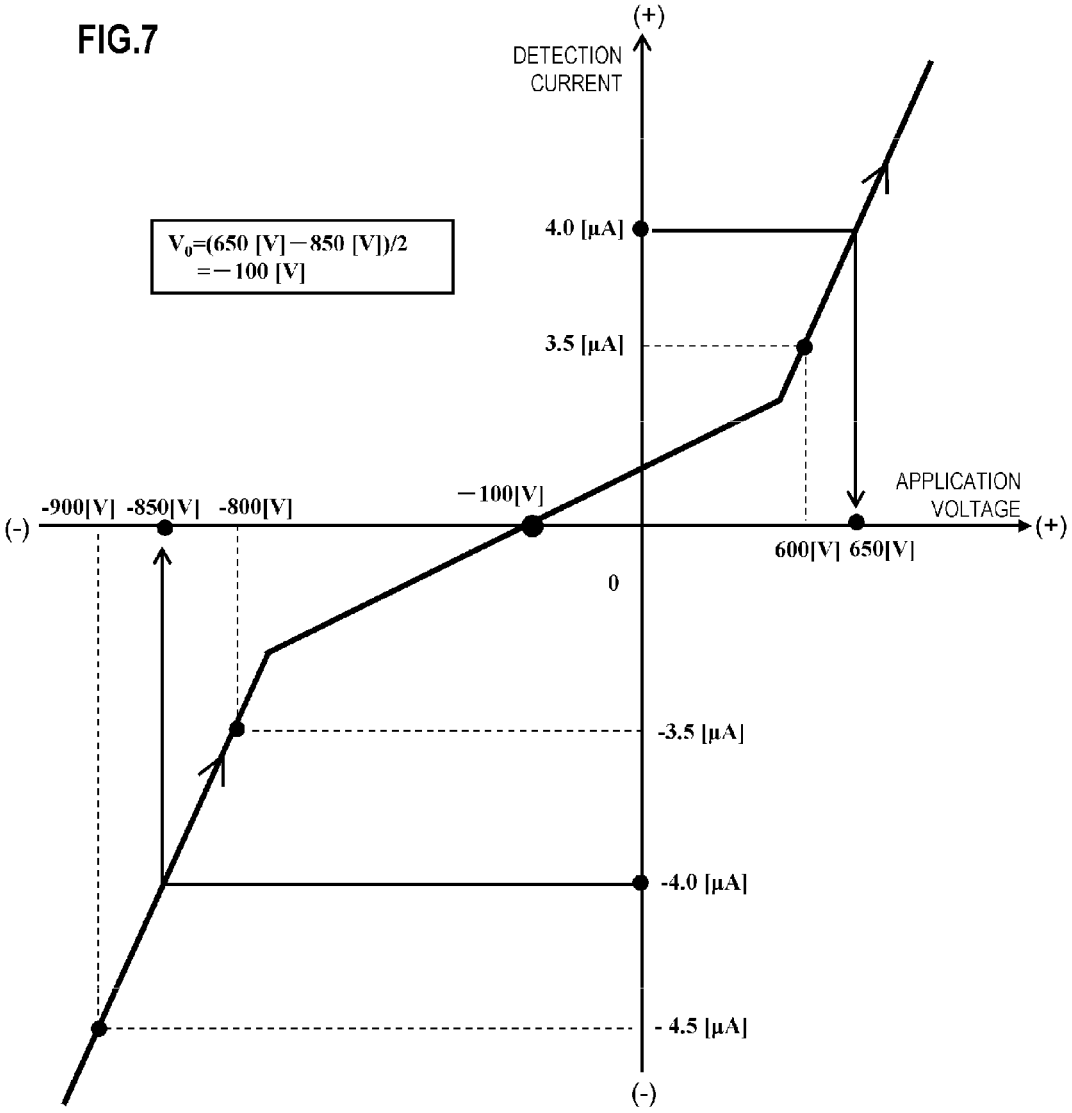
FIG. 7 is a schematic diagram for describing the features of Example 1.

FIG. 7 illustrates the relation between the application voltage value and the detection current value in the configuration of Example 1. In the present embodiment, it is known from prior examinations that, even when the thickness of the photosensitive drum 10, an ambient temperature, an ambient humidity, the sensitivity of the photosensitive drum 10, and the like change in a tolerance range, the maximum discharge start voltage is +600 V on the positive side and −800 V on the negative side. Thus, in the configuration of the present embodiment, when a voltage value equal to or larger than the maximum discharge start voltage is applied, it is possible to perform measurement in the discharge area. In the present embodiment, the current value is measured by applying +600 V on the positive side and −800 V and −900 V on the negative side.

TABLE 1

| | Number of measurement points | Surface potential detection time of photosensitive drum |
|---|---|---|
| Comparative Example 1 | 8 Points | 4.0 [s] |
| Example 1 | 3 Points | 1.5 [s] |

Table 1 illustrates the verification results of the effects of the present embodiment by comparing the time taken to detect the surface potential of the photosensitive drum 10 using the configuration of Example 1 and the configuration of Comparative Example 1. It can be understood from Table 1 that the configuration of the present embodiment can reduce the surface potential detection time of the photosensitive drum 10 to 2.5 s as compared to the configuration of Comparative Example 1. The reasons therefor will be described below. In the configuration of Comparative Example 1, eight points are measured to calculate the discharge start voltages $V_{th1}$ and $V_{th2}$. On the other hand, in the configuration of Example 1, three points equal to or larger than the discharge start voltage value are measured to detect the surface potential of the photosensitive drum 10. Since a period of 0.5 s is taken to detect one point, the detection time is 4.0 s in the configuration of Comparative Example 1 and the detection time is 1.5 s in the configuration of Example 1. The reduction in the number of measurement points is a main factor that enables the surface potential detection time of the photosensitive drum 10 to be reduced in the configuration of Example 1. With the above verification, it is possible to confirm that the present embodiment has an effect of reducing the time taken to detect the surface potential of the photosensitive drum 10 as compared to Comparative Example 1.

Example 2

In Example 2 of the present invention, the surface potential detection means of Example 1 performs a discharge detection sequence of measuring a detection current value at an arbitrary application voltage value and determining whether the application voltage value is equal to or larger than the discharge start voltage. The discharge detection sequence will be described in detail in Section (5). The configuration of the image forming apparatus, the process cartridge, the developing assembly, and the use history recording apparatus according to Example 2 of the present invention is the same as that of Example 1, and the description thereof will not be provided.

In the configuration of Example 2, the absolute value of an application voltage at a measurement point for detecting the surface potential can be set to be lower than that of the configuration of Example 1. In general, it is known that the larger the amount of current discharged to the photosensitive drum 10, the larger the amount of chipping of the surface layer of the photosensitive drum 10. Thus, if the application voltage value when detecting the surface potential can be set to be low, the amount of current discharged to the photosensitive drum 10 decreases, and as a result, the amount of chipping of the surface layer of the photosensitive drum 10 can be reduced.

An object of the present embodiment is to reduce the amount of chipping of the surface layer of the photosensitive drum 10 by decreasing the absolute value of the application voltage at the time of detecting the surface potential. Similarly to Example 1, in the present embodiment, the transfer roller 80 is used for the surface potential detection means. The charging roller 20 may be used for the surface potential detection means as a voltage application member.

The information on the detected surface potential of the photosensitive drum 10 is transmitted to the control portion 90 of the image forming apparatus so that the surface potential of the photosensitive drum 10 is controlled to be constant in the image forming process. For example, a laser intensity of the laser scanner unit, the application voltage value of the charging roller, and the like are controlled. Similarly to Example 1, in the present embodiment, the laser intensity of the laser scanner unit is changed so that the surface potential of the photosensitive drum 10 is controlled to be constant.

(4) Surface Potential Detection Means of Example 2

Figure 8:
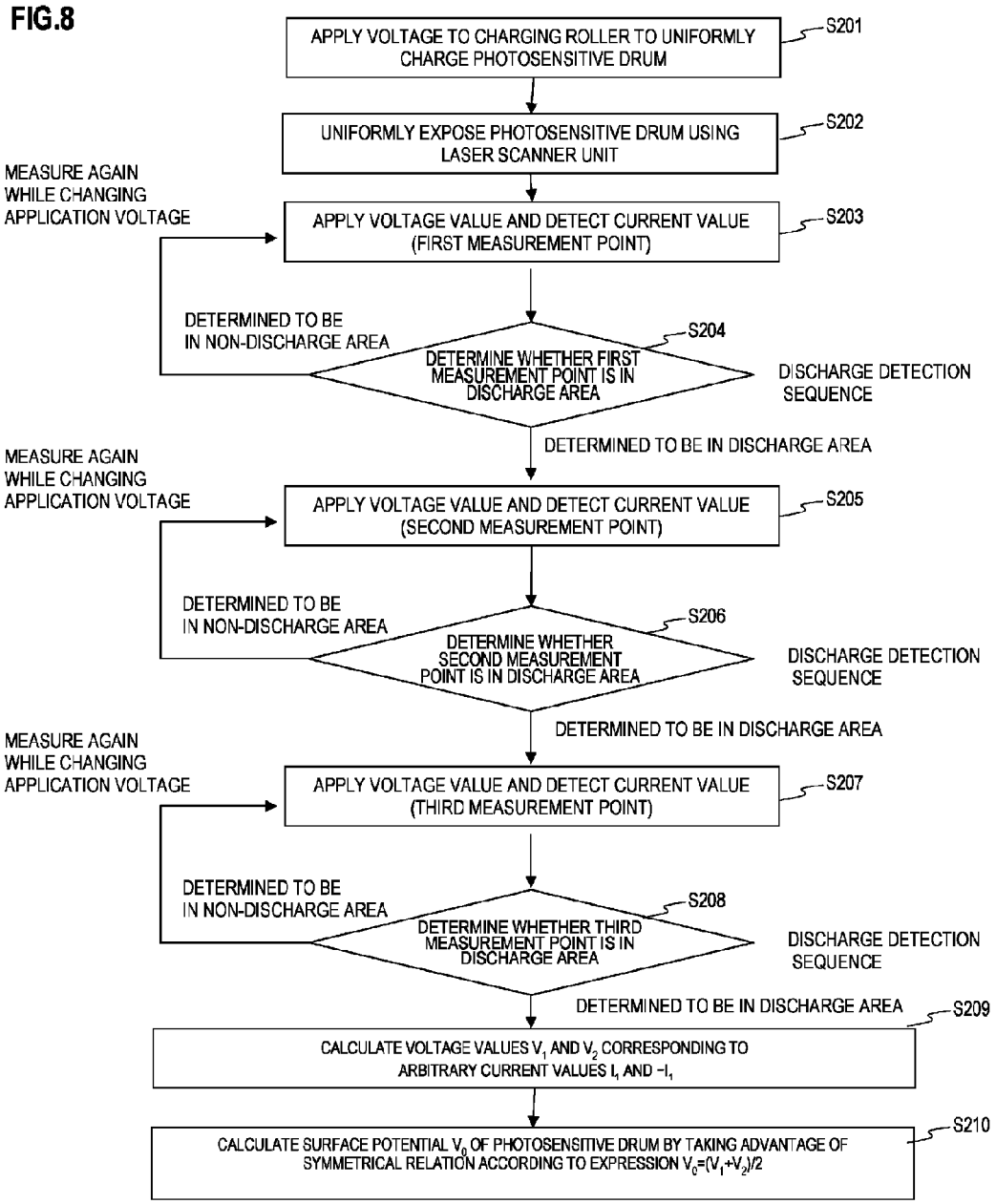
FIG. 8 is a flowchart for describing the features of Example 2.

FIG. 8 is a diagram illustrating the flowchart of a method of detecting the surface potential according to the present embodiment. First, a voltage is applied to the charging roller 20 during rotation of the photosensitive drum 10 so that the photosensitive drum 10 is uniformly charged (S201). In the present embodiment, the surface of the photosensitive drum 10 was charged to −500 V. The surface of the photosensitive drum 10 is uniformly exposed by the laser scanner unit 30 which is an exposure apparatus so that the surface of the photosensitive drum 10 is at an exposure potential (S202). In the present embodiment, the surface was exposed with light intensity of 3 mW/m$^2$. Subsequently, a voltage is applied to the transfer roller 80 and the current flowing through the photosensitive drum 10 at that time is detected by the current value detection means 60.

Figure 9:
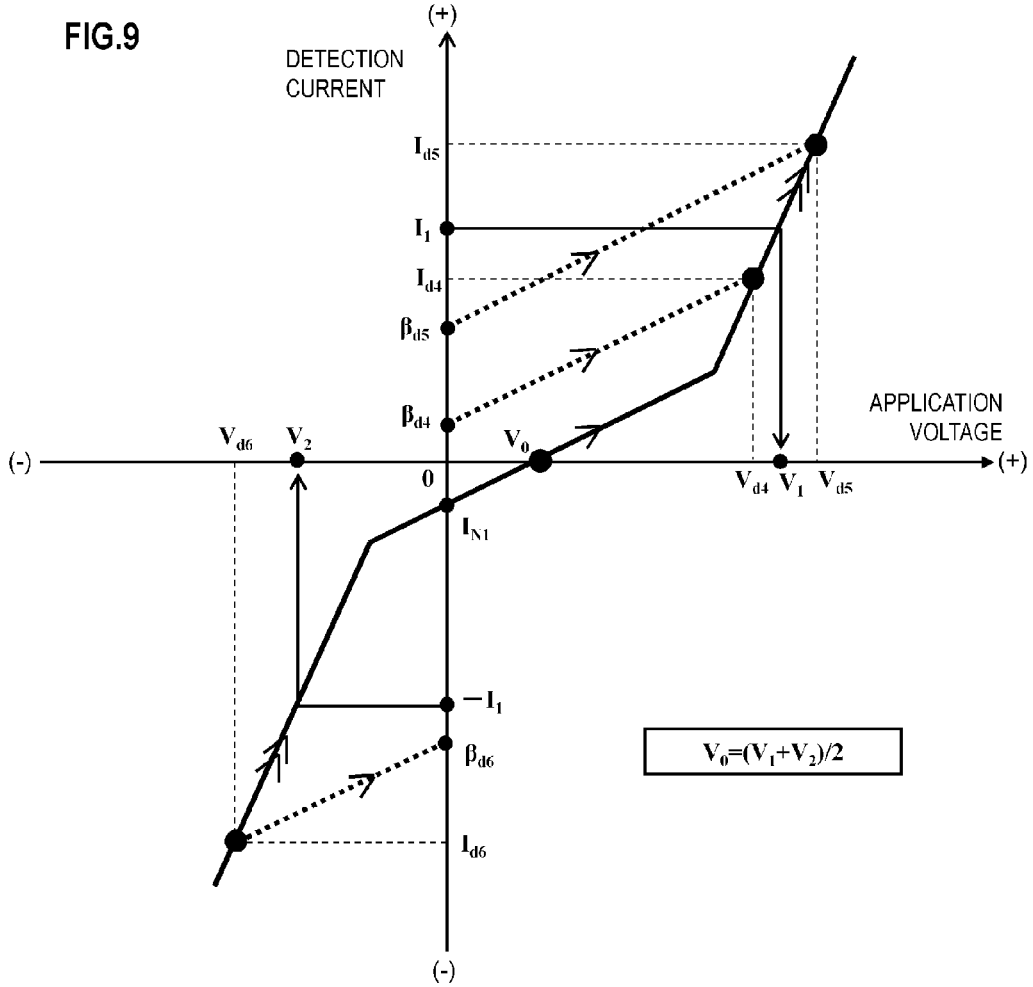
FIG. 9 is a schematic diagram for describing the features of Example 2.

FIG. 9 is a diagram illustrating the relation between an application voltage and a detection current according to the present embodiment. First, an arbitrary voltage value $V_{d4}$ is applied at a first measurement point, and a current value $I_{d4}$ flowing through the photosensitive drum 10 at that time is detected by the current detection means (S203). Moreover, in a discharge detection sequence described later, a determination current value $\beta_{d4}$ and a current value $I_{N1}$ in the non-discharge area are compared to determine whether the first measurement point is in the discharge area (S204). In the present embodiment, the current value when the application voltage value is 0 V was set to $I_{N1}$. If it is determined that the measurement point is not in the discharge area, the absolute value of the application voltage is increased and the current value is detected again. The process of changing the application voltage value and detecting the current value is repeatedly performed until it is determined that the measurement point is in the discharge area.

When it is determined that the first measurement point is in the discharge area, an arbitrary voltage $V_{d5}$ is applied as a second measurement point, and a current value $I_{d5}$ flowing through the photosensitive drum 10 at that time is measured (S205). Similarly to the first measurement point, in the discharge detection sequence, a determination current value $\beta_{d5}$ is compared with the current value $I_{N1}$ in the non-discharge area to determine whether the second measurement point is in the discharge area (S206). If it is determined that the measurement point is not in the discharge area, the absolute value of the application voltage is increased and the current value is detected again similarly to the first measurement point. This process is repeatedly performed until it is determined that the measurement point is in the discharge area.

Subsequently, an arbitrary voltage Vd6 is applied as a third measurement point, and a current value $I_{d6}$ flowing through the photosensitive drum 10 at that time is measured (S207). Similarly to the first and second measurement points, in the discharge detection sequence, a determination current value $\beta_{d6}$ is compared with the current value $I_{N1}$ in the non-discharge area to determine whether the third measurement point is in the discharge area (S208). If it is determined that the measurement point is not in the discharge area, the absolute value of the application voltage is increased and the current value is detected again similarly to the first and second measurement points. This process is repeatedly performed until it is determined that the measurement point is in the discharge area.

The application voltage value is set so that the direction of a current value at one of the first to third measurement points where are determined to be in the discharge area is reverse to the direction of the current value at the other two measurement points. A voltage value $V_0$ at which the current value flowing through the photosensitive drum 10 is zero is calculated using the relation between the application voltage value and the current value at the three measurement points obtained in the above-described procedures. Similarly to Example 1, in the present embodiment, the voltage value $V_0$ is calculated by taking advantage of the symmetry of the discharge area. A voltage value $V_1$ corresponding to an arbitrary current value $I_1$ and a voltage value $V_2$ corresponding to a current value $-I_1$ (of which the absolute value is the same as $I_1$ and the direction is reverse to $I_1$) is calculated (S209), and the surface potential $V_0$ of the photosensitive drum is calculated according to $V_0=(V_1+V_2)/2$ (S210).

Since the configuration of Example 2 has the discharge detection sequence of determining whether the measurement point is in the discharge area as compared to Example 1, the application voltage value at the measurement point for detecting the surface potential can be set to be lower than that of the configuration of Example 1. In the configuration of Example 1, since it is not determined whether the measurement point is in the discharge area, it is necessary to apply a high voltage value at the measurement point in order to ensure that the application voltage value at the measurement point is equal to or larger than the discharge start voltage value. Since the configuration of Example 2 has the discharge detection sequence, it is possible to decrease the application voltage value at the measurement point as compared to the configuration of Example 1.

(5) Discharge Detection Sequence

The discharge detection sequence of the present embodiment takes advantage of the fact that the inclination of the application voltage and the detection current in the discharge area is different from that of the non-discharge area. In general, it is known that the inclination of the application voltage and the detection current in the discharge area is larger than that of the non-discharge area. First, it is assumed that an application voltage value $V_C$ is applied at a measurement point to be determined and a detection current value detected by a current detection member at that time is $I_C$. It is also assumed that a voltage value $V_N$ lower than the discharge start voltage value is applied to a voltage application member, and the current value detected by the current detection member at that time is $I_N$. It is also assumed that the ratio of the voltage value applied to the voltage application member to the current value detected by the current detection member is $\alpha$. In the present embodiment, the ratio $\alpha$ is defined as an inclination of the application voltage and the detection current in the non-discharge area. It is determined whether the measurement point is in the discharge area using the respective values $V_C$, $I_C$, $V_N$, $I_N$, and $\alpha$. The ratio $\alpha$ of the application voltage value to the detection current value will be described in detail in Section (6). From the application voltage value $V_C$ and the detection current value $I_C$ at the measurement point to be determined and the ratio $\alpha$ of the application voltage value to the current value, a linear relational expression of an application voltage value and a detection current value, having the inclination $\alpha$ and passing through the measurement point is defined as Expression (i). Here, $\beta$ is an arbitrary constant.

$$I_C=V_C\times\alpha+\beta \quad \text{(i)}$$

Here, a determination current value $I_{N0}$ is defined as a current value when an application voltage value is set to $V_N$ in the linear relational expression (i) that passes through the measurement point to be determined. When $V_N$ is substituted in Expression (i), the determination current value $I_{N0}$ is defined as Expression (ii).

$$I_{N0}=V_N\times\alpha+I_C-V_C\times\alpha=\alpha(V_N-V_C)+I_C \quad \text{(ii)}$$

If the measurement point is not in the discharge area, the determination current value $I_{N0}$ defined by Expression (ii) is equal to the detection current value $I_N$ in the non-discharge area, measured in advance. On the other hand, if the measurement point is in the discharge area, the determination current value $I_{N0}$ defined by Expression (ii) will be different from the detection current value $I_N$ in the non-discharge area, measured in advance. Thus, when the determination current value $I_{NO}$ is compared with the detection current value $I_N$ in the non-discharge area, if $I_{N0}=I_N$, it is determined that the measurement point to be determined is not in the discharge area. If $I_{N0}\neq I_N$, is determined that the measurement point to be determined is in the discharge area. By using the discharge detection sequence, it is possible to determine whether the measurement point is in the discharge area.

That is, in the present embodiment, a plurality of voltages of different values are applied while determining whether the application voltage value and the detection current value are in the discharge area (that is, the application voltage value is equal to or larger than the discharge start voltage value) whenever the voltage is applied (every voltage application). At least three application voltage values to be used for detection (calculation) of the surface potential of the photosensitive drum 10 are selected (determined) among the plurality of application voltage values. When the application voltage value is determined to be smaller than the discharge start voltage value, a voltage larger than the previous voltage value is applied and it is determined whether the present application voltage value exceeds the discharge start voltage value. According to the present embodiment, even when a voltage having such a large value which is expected to be reliably in the discharge area is not applied unlike Example 1, it is possible to select a voltage value for detection of the surface potential by applying a voltage located close to the boundary between the non-discharge area and the discharge area. In the best case, three application voltage values can be determined by applying voltages three times, and the magnitude of the voltage value can be made smaller than that of Example 1.

(6) Ratio $\alpha$ of Application Voltage Value to Detection Current Value

In the discharge detection sequence, it is necessary to calculate the ratio $\alpha$ of the application voltage value to the detection current value. The ratio $\alpha$ of the application voltage value to the detection current value changes depending on parameters such as an ambient temperature, an ambient humidity, and the thickness of the photosensitive drum 10. When the ambient temperature and the ambient humidity change, the electrical resistance value of the transfer roller 80 which is the surface potential detection means changes. Accordingly, the relation between the application voltage value and the detection current value changes whereby the ratio $\alpha$ of the application voltage value to the detection current value also changes. Moreover, when the thickness (specifically, the thickness of a charge transport layer which is the surface layer) of the photosensitive drum 10 changes, the electrical resistance value of the photosensitive drum 10 changes whereby the relation between the application voltage value and the detection current value changes and the ratio $\alpha$ also changes.

In the present embodiment, the ratio $\alpha$ is calculated from the thickness of the photosensitive drum 10, the ambient temperature, and the ambient humidity. The thickness of the photosensitive drum 10 is calculated by the use history recording apparatus of the image forming apparatus. The use history recording apparatus will be described in detail in Section (7). Moreover, the information on the ambient temperature and the ambient humidity is obtained from an environment sensor 70 (temperature and humidity detection portion) provided in the image forming apparatus. The relation between the ratio $\alpha$ and the thickness of the photosensitive drum 10, the ambient temperature, and the ambient humidity is calculated in advance to obtain a value indicating the relation and the ratio α is calculated.

A method of calculating the ratio α is not limited to the above-described method, and the ratio α may be calculated according to the other methods. For example, the ratio α may be calculated from the measurement results of the two points of the application voltage value and the detection current value in the non-discharge area. The ratio α may be measured at the time of shipping products and recorded in the body of the image forming apparatus, and the ratio α may be corrected and calculated from the parameters. Moreover, since the ratio of the application voltage value and the detection current value in the discharge area is correlated with the ratio of the application voltage value to the detection current value in the non-discharge area, the ratio of the application voltage value to the detection current value in the non-discharge area may be calculated from the ratio of the application voltage value to the detection current value in the discharge area.

(7) Use History Recording Apparatus

In the present embodiment, the rotation period (use period) of the photosensitive drum 10 is counted as the "use history value" of the developing assembly 40, stored in the memory 12. The rotation period of the photosensitive drum 10 and the amount of change in the thickness of the photosensitive drum 10 are calculated in advance, and the thickness of the photosensitive drum 10 at the time of detection of the surface potential is calculated based on the initial thickness of the photosensitive drum 10 and the rotation period of the photosensitive drum 10, stored in the memory 12. Moreover, the thickness information is transmitted to the control portion 90 of the image forming apparatus. The relation between the ratio α and the thickness of the photosensitive drum 10 is calculated in advance. In the discharge detection sequence of the present embodiment, the thickness information of the photosensitive drum 10 is one of the parameters used for calculating the ratio α.

(Effect Verification 2)

Figure 10:
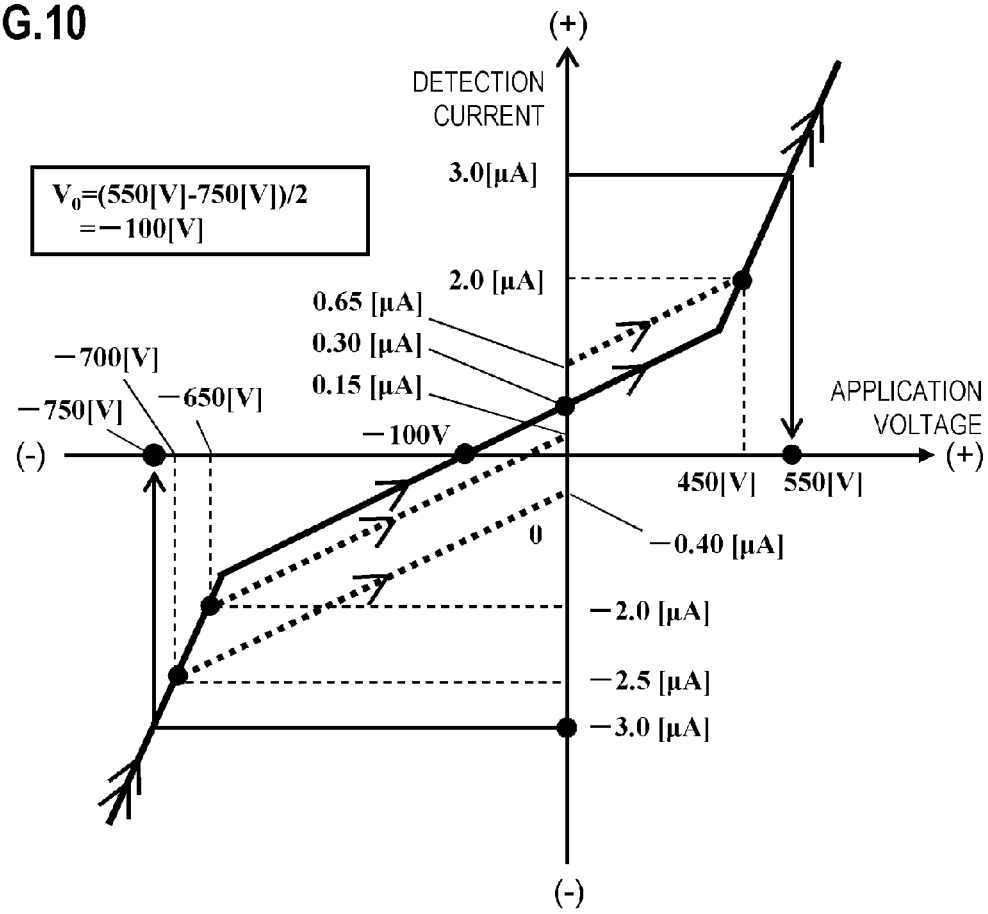
FIG. 10 is a schematic diagram for describing the features of Example 2.

FIG. 10 is a diagram illustrating the relation between the application voltage value and the detection current value in the configuration of Example 2 to verify the effect of reducing the application voltage at the time of detecting the surface potential of the photosensitive drum 10 and the effect of reducing the amount of chipping of the thickness of the photosensitive drum 10 according to the present embodiment. In this example, the following verifications were conducted.

In Example 2, the application voltage values were set to +450 V, −650 V, and −700 V and the current values at the respective application voltages were detected. In this case, the determination current values at the respective measurement points were calculated in the discharge detection sequence and compared with a reference current value, and it was determined that all of the three measurement points were in the discharge area. Comparative Example 1 for verifying the effects of Example 2 is the same as that in Effect Verification 1 of Example 1, and the description thereof will not be provided.

A 10 k durability test which is a durability test after passing of 10 k sheets was performed for Comparative Example 1, Example 1, and Example 2, and the amounts of chipping of the thickness of the surface layer of the photosensitive drum 10 in the respective configurations were compared. A continuous sheet passing method was used for all configurations and the surface potential was detected whenever 0.1 k sheets were passed. The results are illustrated in Table 2.

TABLE 2

| | Application voltage value | Number of measurement points | Photosensitive drum chipping amount after 10k durability test | Surface potential detection time |
|---|---|---|---|---|
| Comparative Example 1 | +300 [V]<br>+350 [V]<br>+400 [V]<br>+450 [V]<br>−500 [V]<br>−550 [V]<br>−600 [V]<br>−650 [V] | 8 Points | 4.5 [μm] | 4.0 [s] |
| Example 1 | +600 [V]<br>−800 [V]<br>−900 [V] | 3 Points | 4.0 [μm] | 1.5 [s] |
| Example 2 | 0 [V]<br>+450 [V]<br>−650 [V]<br>−700 [V] | 4 Points | 3.5 [μm] | 2.2 [s] |

Table 2 shows that the amount of chipping of the thickness of the photosensitive drum 10 after the 10 k durability test was 4.5 μm for the configuration of Comparative Example 1, 4.0 μm for the configuration of Example 1, whereas 3.5 μm for the configuration of Example 2. It can be understood that the configuration of Example 2 provided the smallest chipping amount of the photosensitive drum 10. The reasons therefor will be described below.

In the configuration of Example 1, a high voltage value is applied at the measurement point to ensure that the application voltage value at the measurement point is reliably equal to or larger than the discharge start voltage value. The application voltage values at the measurement points were +600 V, −800 V, and −900 V in the configuration of Example 1 whereas the application voltage values at the measurement points were +450 V, −650 V, and −700 V in the configuration of Example 2. It can be understood that the configuration of Example 2 can decrease the application voltage value as compared to Example 1. This difference in the application voltage value is a main factor that enables the chipping amount of the photosensitive drum 10 after the 10 k durability test to be decreased in the configuration of Example 2. In product design according to the present embodiment, it is allowable if the amount of chipping of the thickness of the photosensitive drum 10 is within 5.0 μm per passing of 10 k sheets. Thus, although the amounts of chipping of the surface layer of the photosensitive drum 10 were allowable levels for all configurations, the configuration of Example 2 can better reduce the chipping amount.

In the configuration of Comparative Example 1, since the voltages at eight voltages are applied to calculate the discharge start voltage and the number of measurement points is larger than that of Example 2, the chipping amount of the photosensitive drum 10 is larger than that of Example 2. The surface potential detection time of Example 2 is slightly longer than that of Example 1. This is because the number of measurement points of Example 2 is 4 and is larger by 1 than that of Example 1, and the time taken to determine whether the measurement point is in the discharge area is increased. However, it can be understood that the detection time is shorter than that of Comparative Example 1.

With the above verification, it is possible to confirm that the present embodiment has an effect of reducing the chipping amount of the photosensitive drum 10 as compared to the configuration of Example 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-044417, filed Mar. 6, 2015, which is hereby incorporated by reference herein in its entirety.

What is claimed is:

1. An image forming apparatus comprising:

an image bearing member that bears a toner image for forming an image on a recording material;

a voltage application member that applies a voltage to the image bearing member;

a current detection portion that detects a current value of current flowing through the image bearing member;

a potential detection portion that calculates a voltage value $V_0$ at which a detection current value detected by the current detection portion is zero based on the application voltage value applied by the voltage application member to the image bearing member and the detection current value detected when the application voltage value is applied; and a latent image forming portion that forms on a surface of the image bearing member a potential difference for forming an electrostatic latent image for forming the toner image on the surface of the image bearing member based on the voltage value $V_0$ calculated by the potential detection portion, wherein the voltage application member applies voltages to the image bearing member using at least three application voltage values which are larger than a discharge start voltage value, which is a voltage value at which discharge starts occurring between the image bearing member and the voltage application member, and which have different magnitudes, at least one of the three application voltage values being a value at which a direction of a current corresponding to the one of the application voltage values is reverse to those of currents corresponding to the other application voltage values, the potential detection portion calculates a relation between the application voltage value and the detection current value in a discharge area in which the discharge occurs, based on the at least three application voltage values and at least three detection current values detected by the current detection portion in relation to the at least three application voltage values, and the potential detection portion calculates the voltage value $V_0$ according to Expression (1) based on the relation in the discharge area, in which $V_1$ is a voltage value corresponding to a predetermined current value $I_1$ in the discharge area and $V_2$ is a voltage value corresponding to a current value $-I_1$:

$$V_0=(V_1+V_2)/2 \quad (1).$$

2. The image forming apparatus according to claim 1, wherein the voltage application member applies voltages a plurality of number of times using a plurality of application voltage values having different magnitudes, and the potential detection portion selects the at least three application voltage values among the plurality of application voltage values, based on a plurality of detection current values detected by the current detection portion in relation to the plurality of application voltage values.

3. The image forming apparatus according to claim 2, wherein the potential detection portion determines whether the application voltage value in a single voltage application is equal to or larger than the discharge start voltage value, based on the application voltage value in the single voltage application and a detection current value detected by the current detection portion in the single voltage application whenever single voltage application is implemented in the plurality of voltage applications by the voltage application member, and when the application voltage value in the single voltage application is equal to or larger than the discharge start voltage value, the potential detection portion selects the application voltage value in the single voltage application as one of the at least three application voltage values.

4. The image forming apparatus according to claim 3, wherein when the potential detection portion determines that the application voltage value in the single voltage application is smaller than the discharge start voltage value, the voltage application member includes in the plurality of voltage applications a voltage application using an application voltage value larger than the application voltage value in the single voltage application, the potential detection portion determines whether the larger application voltage value is equal to or larger than the discharge start voltage value based on the larger application voltage value and a detection current value detected by the current detection portion in relation to the larger application voltage value, and when the larger application voltage value is equal to or larger than the discharge start voltage value, the potential detection portion selects the larger application voltage value as one of the at least three application voltage values.

5. The image forming apparatus according to claim 3, wherein the plurality of voltage applications are repeatedly performed until the potential detection portion determines that at least three application voltage values are equal to or larger than the discharge start voltage value.

6. The image forming apparatus according to claim 2, wherein when $\alpha$ is a predetermined ratio of a change in a detection current value to a change in an application voltage value in a non-discharge area in which the discharge does not occur, $V_C$ is one of the plurality of application voltage values, $I_C$ is a detection current value detected by the current detection portion when the application voltage value $V_C$ is applied, $I_N$ is a detection current value detected by the current detection portion when an application voltage value $V_N$ smaller than the discharge start voltage value is applied, and $I_{N0}$ is a determination current value for determining whether the application voltage value $V_C$ is equal to or larger than the discharge start voltage value, the potential detection portion determines that the application voltage value VC satisfying $I_{N0} \neq I_N$ is equal to or larger than the discharge start voltage value according to Expression (2) and selects the application voltage value $V_C$ as one of the at least three application voltage values:

$$I_{N0}=\alpha(V_N-V_C)+I_C \quad (2).$$

7. The image forming apparatus according to claim 6, wherein the potential detection portion determines that the application voltage value $V_C$ satisfying $I_{N0}=I_N$ is smaller than the discharge start voltage value and does not select the application voltage value $V_C$ as one of the at least three application voltage values.

8. The image forming apparatus according to claim 6, further comprising:

a temperature and humidity detection portion that detects an ambient temperature and an ambient humidity, wherein the image bearing member is a photosensitive drum, and the ratio $\alpha$ is calculated from a thickness of a charge transport layer of the photosensitive drum calculated based on a use period of the image bearing member and the ambient temperature and the ambient humidity detected by the temperature and humidity detection portion.

9. The image forming apparatus according to claim 1, wherein in the discharge area, a ratio of a change in the application voltage value to a change in the detection current value is larger than the ratio in a non-discharge area in which the discharge does not occur.

10. The image forming apparatus according to claim 1, wherein the voltage applied by the voltage application member is a DC voltage.

11. The image forming apparatus according to claim 1, wherein the voltage application member is a transfer member that applies to the image bearing member a transfer voltage for transferring a toner image formed on the surface of the image bearing member to the recording material.

12. The image forming apparatus according to claim 1, further comprising:

an intermediate transfer member to which the toner image is transferred from the image bearing member and which transfers the transferred toner image to the recording material, wherein the voltage application member is a transfer member that applies to the image bearing member a transfer voltage for transferring the toner image formed on the surface of the image bearing member to the intermediate transfer member.

13. The image forming apparatus according to claim 1, wherein the latent image forming portion includes:

a charging portion that charges the image bearing member; and an exposure portion that exposes the surface of the image bearing member so that the potential difference is formed.

* * * * *